United States Patent [19]

Claye et al.

[11] 4,031,973

[45] June 28, 1977

[54] PLACER MINING TOOL

[76] Inventors: Robert G. Claye, 420 South St., Yreka, Calif. 96097; David S. Wilson, P.O. Box 12, Klamath River, Calif. 96050

[22] Filed: Nov. 10, 1975

[21] Appl. No.: 630,530

[52] U.S. Cl. ..... 175/320; 175/60; 175/213; 175/388; 299/9

[51] Int. Cl.[2] ..... E21B 49/00

[58] Field of Search ..... 299/8, 9; 175/385, 388, 175/320, 213, 60, 391; 37/64, 65

[56] References Cited

UNITED STATES PATENTS

| | | | |
|---|---|---|---|
| 203,637 | 5/1878 | Mull | 175/388 |
| 863,700 | 8/1907 | Crosby | 299/8 |
| 996,450 | 6/1911 | Bouchet | 175/385 |
| 1,479,894 | 1/1924 | Carey | 175/385 |
| 1,861,632 | 6/1932 | Haynie | 175/388 |
| 2,057,691 | 10/1936 | Ranney | 299/9 X |
| 2,784,944 | 3/1957 | Freeman | 175/385 |
| 3,144,912 | 8/1964 | Boehm et al. | 175/320 X |
| 3,995,439 | 12/1967 | Hahlbrock | 37/65 X |

*Primary Examiner*—Ernest R. Purser
*Assistant Examiner*—Richard E. Favreau
*Attorney, Agent, or Firm*—Clarence M. Crews

[57] ABSTRACT

This invention relates to placer mining and more particularly to a novel bit adapted for use in stream beds, dependably to break up and deliver to and through a sluice box a quantity of divided, water-borne gravel, sand, clay and ore for the conventional analysis and segregation of the precious metal or metals contained therein. There have been prior proposals of a generally similar nature but the material dislodging bits employed have been so poorly designed that they have been severely limited in capacity or have quickly become clogged by gravel, clay, etc. so that the ore digging operation has had to be frequently interrupted for the elimination of obstructing material. The present invention substantially eliminates this shortcoming.

2 Claims, 6 Drawing Figures

PLACER MINING TOOL

This invention relates to placer mining and more particularly to a novel bit for digging up clay, sand, gravel and ore from a stream bed and transmitting them with a useful quantity of water through a sluice box.

There have been prior proposals for the utilization of manually operable bits at the intake end of organizations of the kind referred to but, so far as we are aware, such proposals have been impractical for the reason that the bit structure was severely limited in capacity, or quickly became clogged and inoperative until a thorough and tedious clearing job has been performed.

It is the primary object of this invention to provide a manually operable intake nozzle which will take in clay, sand and large gravel, together with water and the ore, in large quantities and pass them through for processing without the necessity for frequent interruption to clear stoppages.

To this end, it is a feature of the invention that a nozzle is provided, adapted for manual rotary reciprocation, and characterized by the fact that the spaces between nozzle blades individually exceed the maximum width of a blade and that the blades are twisted and taper to a point at their leading ends, where they are joined to one another.

In the drawings forming part of this specification,

Figure 1:
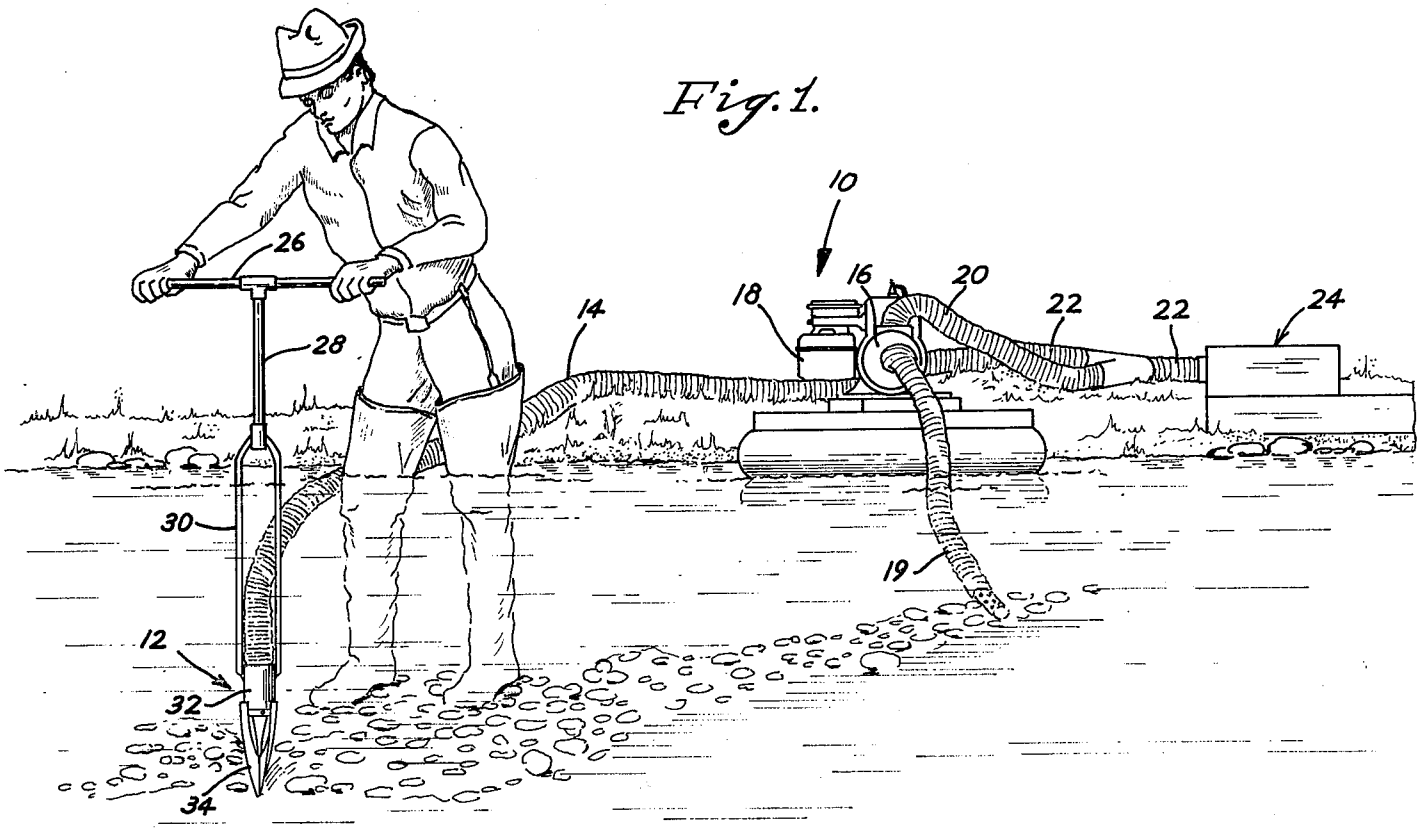
FIG. 1 is a view in elevation of a complete placer mining organization in operation, in which our novel bit is employed.

As seen in FIG. 1, a mining apparatus 10 is shown, using a bit 12 in a stream bed. The bit 12 is adapted to be manually rotatively reciprocated through any desired angle up to about 180 degrees, and from time to time to be thrust forcibly downward.

Sand, gravel, clay and precious ore thus loosened are transmitted through a flexible conduit 14, to a conventional pump 16, driven by a conventional internal combustion engine 18. The pump 16, as usual, draws in additional water through a flexible conduit 19 and delivers it through a flexible conduit 20 for admixture with the ore in the discharge conduit 22. The discharge conduit 22 delivers the water, and the water-carried sand, gravel, clay and ore, to a conventional sluice box 24 wherein the precious ore is separated and collected in a conventional and well understood manner from the various materials of less specific gravity than itself.

Figure 2:
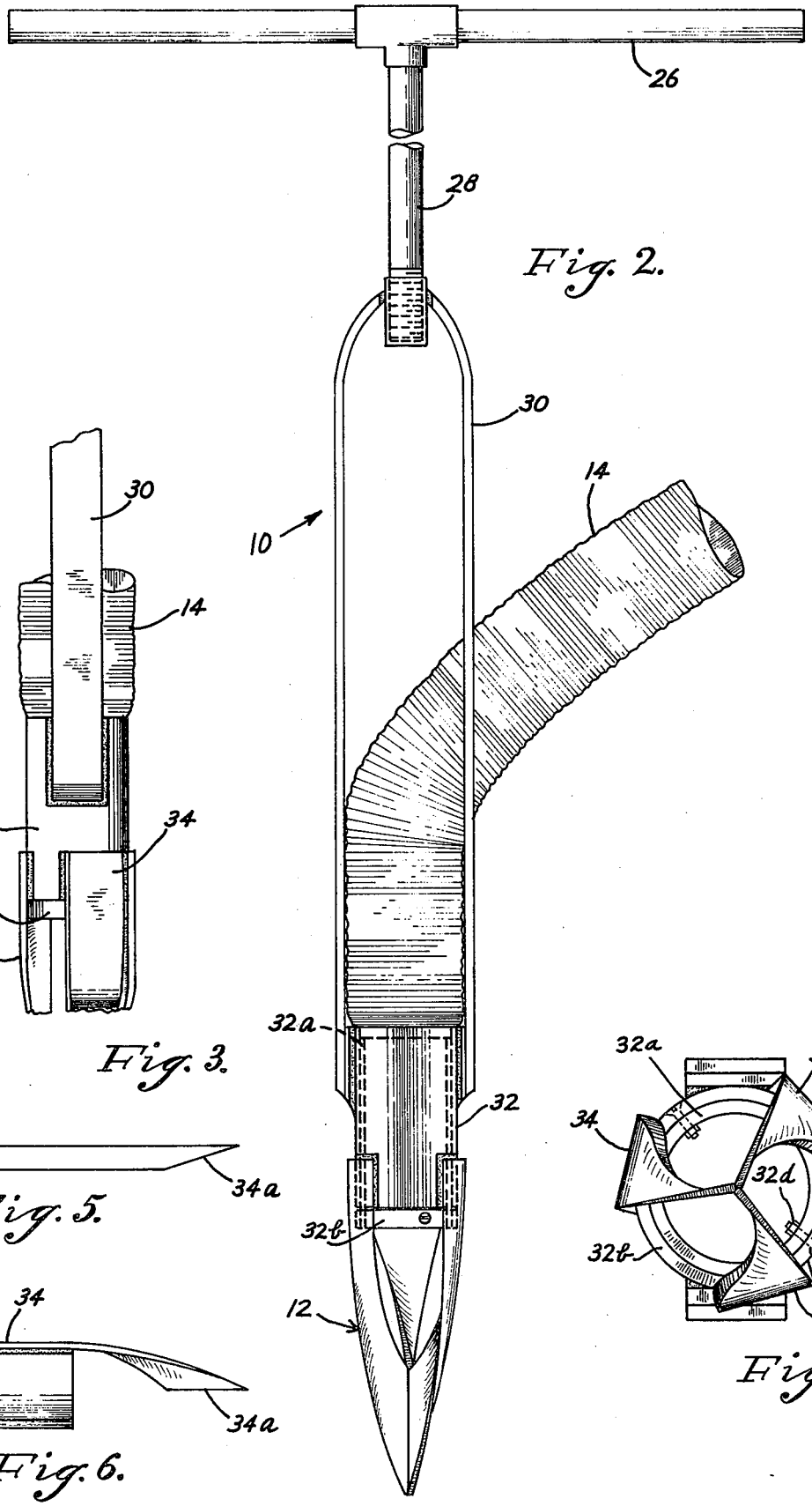
FIG. 2 is a fragmentary view illustrating the novel bit and the operating means therefor.
Figure 3:
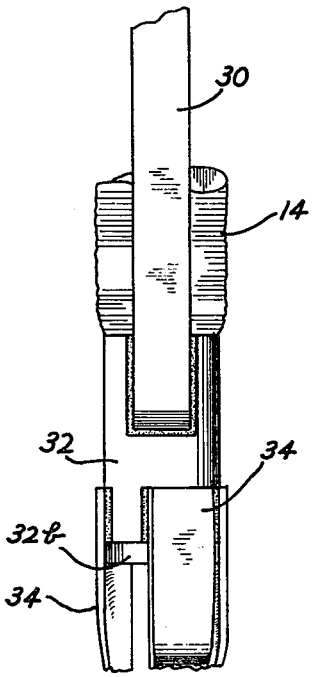
FIG. 3 is a fragmentary view in side elevation showing significant portions of the bit and the operating means thereof.
Figure 5:
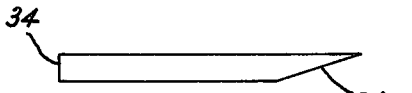
FIG. 5 shows a bit tooth before twisting.
Figure 6:
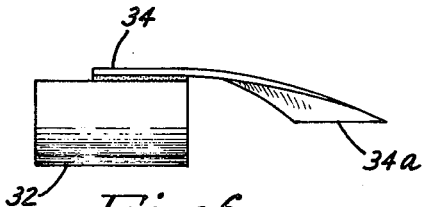
FIG. 6 shows a single bit tooth associated with a bit sleeve after twisting.
Figure 4:
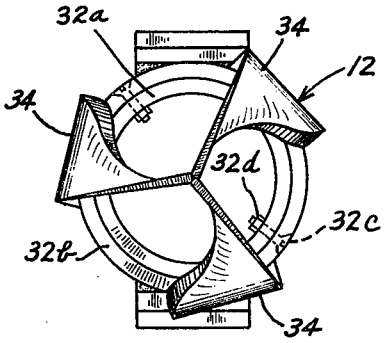
FIG. 4 is a bottom plan view of the bit.

The significant novelty of the present invention lies primarily in the bit 12 as illustrated in FIGS. 2, 3 and 4, which bit is appropriately adapted to the size of an outer sleeve 32.

A handle 26 is connected through a stem 28 and a yoke 30 with the outer sleeve 32. The sleeve 32 has rigidly connected to it, as by welding, three bit members 34. Each bit member 34, in its broadest part, extends for less than the space between adjacent members.

Each bit member 34 is of generally rectangular form but has a twenty degree miter at its lower end to form an oblique edge 34*a*. Each of the three members 34 is twisted to bring the three edges 34*a* together at the center. The edges 34*a* are welded to one another. The upper end of each member 34 is welded to the outer base of the outer sleeve 32, being bent to the curvature of the sleeve.

The upper ends of the members 34 are uniformly spaced apart by distances which exceed their own uniform widths. Each such space desirably exceeds 60°.

Provision is made for enabling the bit 12 to be turned by the handle 26 through stem 28, yoke 30 and outer sleeve 32 without necessarily turning the hose 14. To this end and the flexible hose 14 is attached to the upper end of an inner sleeve 32*a* that protrudes at both its upper and lower ends beyond the sleeve 32. The lower protruding end of the inner sleeve 32*a* has fast upon it a retaining ring 32*b*, the retaining ring 32*b* being affixed to the inner sleeve 32*a* by countersunk screws 32*c* and nuts 32*d*.

By virtue of the described arrangement the bit 12 and the outer sleeve 32 can be turned freely by the handle relative to the inner sleeve, the retaining ring, and the hose 14.

The reciprocation of the handle 26 serves to loosen gravel, clay, sand and ore in the stream bed and to initiate their travel, together with water, through the conduit 14. The intake passages between the members 34 are wider than the widest portions of the members 34 and the entire internal diameter of the inner sleeve 32*a* is wide open so that the possibility of clogging is reduced to a minimum.

We have described what we believe to be the best embodiment of our invention. What we desire to cover by letters patent, however, is set forth in the appended claims.

We claim:

1. A manually operable ore digging instrumentality for use in placer mining including, in combination,
   a. a bit carrying sleeve of substantial diameter,
   b. manually operable means for turning the sleeve back and forth and for thrusting it downward continuously or intermittently as required, and
   c. bit forming means fixedly attached to said sleeve consisting of three like arcuate earth-boring segments, the segments being generally rectangular in shape but each tapered at a small acute angle along its lower end, and being twisted to bring the beveled edges at their lower ends to a common axis along which they are united to one another, but being spaced from one another at their widest portions by substantially more than their own individual widths, the construction and arrangement being such that material dislodged in pieces or chunks by manual reciprocation of the bit whose maximum dimensions do not exceed the maximum width of a bit segment can be accepted between the bit segments and pass unobstructedly through the sleeve.

2. An ore digging instrumentality as set forth in claim 1 in which it is an outer sleeve which carries the bit segments, provision is made of means operable to turn the bit through the outer sleeve, and of an inner sleeve upon which the outer sleeve is mounted, to which inner sleeve a flexible ore and water conducting conduit is connected, and a retaining ring surrounds and is affixed to the receiving end of the inner sleeve in position to confine the outer sleeve against endwise movement while leaving it free to turn in unison with the bit and relative to the inner sleeve.

* * * * *